US010227266B2

(12) United States Patent
Klunker et al.

(10) Patent No.: US 10,227,266 B2
(45) Date of Patent: Mar. 12, 2019

(54) DETONATOR-SENSITIVE ASSEMBLED BOOSTER CHARGES FOR USE IN BLASTING ENGINEERING AND THE USE THEREOF

(71) Applicant: EST ENERGETICS GMBH, Rothenburg (DE)

(72) Inventors: Jürgen Klunker, Niesky (DE); Konrad Ziegler, Bernburg Saale (DE)

(73) Assignee: EST ENERGETICS GMBH, Rothenburg (DE)

( * ) Notice: Subject to any disclaimer, the term of this patent is extended or adjusted under 35 U.S.C. 154(b) by 590 days.

(21) Appl. No.: 14/442,197

(22) PCT Filed: Nov. 12, 2013

(86) PCT No.: PCT/EP2013/073658
§ 371 (c)(1),
(2) Date: May 12, 2015

(87) PCT Pub. No.: WO2014/076099
PCT Pub. Date: May 22, 2014

(65) Prior Publication Data

US 2016/0052835 A1 Feb. 25, 2016

(30) Foreign Application Priority Data

Nov. 14, 2012 (DE) ..... 10 2012 110 955

(51) Int. Cl.

| | |
|---|---|
| ***C06B 23/00*** | (2006.01) |
| ***C06B 25/36*** | (2006.01) |
| ***F42D 3/00*** | (2006.01) |
| ***C06C 7/00*** | (2006.01) |
| ***C06B 25/34*** | (2006.01) |

(52) U.S. Cl.
CPC ..... *C06B 23/003* (2013.01); *C06B 25/34* (2013.01); *C06B 25/36* (2013.01); *C06C 7/00* (2013.01); *F42D 3/00* (2013.01)

(58) Field of Classification Search
CPC ..... C06B 23/00; C06B 25/36; F42D 3/00
See application file for complete search history.

(56) References Cited

U.S. PATENT DOCUMENTS

| | | | |
|---|---|---|---|
| 3,338,165 | A | 8/1967 | Minnick |
| 3,475,236 | A | 10/1969 | Walker et al. |
| 3,713,915 | A | 1/1973 | Fast |
| 3,718,512 | A | 2/1973 | Hurst |
| 3,797,392 | A | 3/1974 | Eckels |
| 3,902,933 | A | 9/1975 | Chandler |
| 4,317,691 | A | 3/1982 | Katsuta et al. |

(Continued)

FOREIGN PATENT DOCUMENTS

| | | | |
|---|---|---|---|
| AU | 441544 | B2 | 5/1972 |
| DE | 2149979 | A1 | 4/1972 |

OTHER PUBLICATIONS

International Search Report and Written Opinion issued in PCT/EP2013/073658 (in German), dated May 28, 2014.

*Primary Examiner* — Aileen B Felton
(74) *Attorney, Agent, or Firm* — Heslin Rothenberg Farley & Mesiti P.C.

(57) ABSTRACT

This invention relates to detonator-sensitive assembled booster charges for use in blasting engineering. The booster charge comprises nitroalkane and a cavity-forming agent.

24 Claims, 1 Drawing Sheet

(56) References Cited

U.S. PATENT DOCUMENTS

| | | | | |
|---|---|---|---|---|
| 4,334,476 | A | 6/1982 | Day | |
| 5,970,841 | A | 10/1999 | Trocino | |
| 6,007,648 | A | 12/1999 | Sullivan et al. | |
| 6,405,627 | B1 | 6/2002 | Anderson | |
| 6,960,267 | B1 * | 11/2005 | Nixon, III | C06B 25/36 149/109.6 |

* cited by examiner

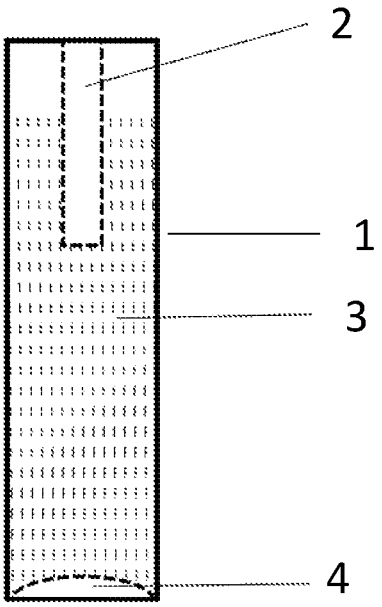
2
1
3
4

DETONATOR-SENSITIVE ASSEMBLED BOOSTER CHARGES FOR USE IN BLASTING ENGINEERING AND THE USE THEREOF

CROSS REFERENCE TO RELATED APPLICATIONS

This application is a U.S. National Phase filing under 35 U.S.C. § 371 of International Application No. PCT/EP2013/073658, filed Nov. 12, 2013, and published as WO 2014/076099-A2 on May 22, 2014, which claims benefit of priority from German Patent Application Serial No. DE 10 2012 110 955.9, filed Nov. 14, 2012. The entire contents of each of the prior applications are incorporated herein by reference in their entirety.

FIELD OF THE INVENTION

The invention concerns detonator-sensitive assembled booster charges for use in blasting engineering.

BACKGROUND OF THE INVENTION

Insensitive, non-toxic and inexpensive explosives, mostly based on ammonium nitrate, are preferentially used in civil blasting applications. In salt mining or tunnel driving, for example, so-called pumping explosives are used in addition to the long familiar ANFO. Pump explosives are differentiated into emulsion explosives and suspension explosives (slurries, explosive slurries).

ANFO (Ammonium Nitrate Fuel, trade name e.g. ANDEX) is a mixture of porous ammonium nitrate and mineral oil or diesel oil (fuel oil), which is used in the mining industry as a safe-to-handle explosive.

In addition, if not sufficient for safe ignition, these explosives require so-called primary explosives in conjunction with detonator-sensitive assembled initiation charges (boosters, amplifier charges or primers). Primary explosives can be found in commercial detonators. Primary explosives are characterized by high sensitivity to friction, shock, impact and heat. Mercury fulminate, for example, can already be detonated by heating to 160° C. (detonating cord) or by a 2 kg drop hammer falling from a height of 4 cm. Initial detonation with blasting caps was invented in 1862 by Alfred Nobel. Important primary explosives are mercury fulminate, lead azide, silver azide, silver acetylide, silver fulminate, diazodinitrophenol, lead picrate (trinitrophenol lead), lead styphnate (lead trinitroresorcinate), tetracene, nickel hydrazine nitrate (NHN), hexamethylene triperoxide diamine (HMTD), acetone peroxide (DADP, TATP or APEX), 3-nitrobenzenediazonium perchlorate, mercury azides, tetraamine copper (II) chlorate (TACC) and copper acetylide.

Pressed cylindrical explosive devices made of tetryl, trinitrotoluene, phlegmatized (reduction of sensitivity) hexogen, pentaerythritol tetranitrate (PETN), picric acid and other explosives are usually used as detonator-sensitive assembled booster charges, also referred to as initial gain detonator or IG detonator. Common to all these substances is a greater sensitivity to the initial pulse than that of the explosive of the main charge (e.g. ANFO, cast TNT, powdery explosives). Primer cartridges of gelatinized explosives are often used in rock blasting as an additional amplification charge to initiate the main charge of powdery explosives or emulsion explosives. The weight and the shape of the IG detonator are calculated so that, at detonation, a pulse is produced that ensures the triggering of the detonation of the main charge and the desired detonation behavior. The initiation of the IG detonator is triggered by a blasting cap, an electric detonator or a NE-igniter (non-electric igniter).

The problem with the IG detonators used to date is that they either consist of long term no longer available military explosives (pressed TNT, cast Composition B, etc.), or that classic primer cartridges made of gelatinous explosives (dynamite successors on the basis of blasting oil) are used, which becomes problematic in the long term. Besides the increased health hazard from nitric acid ester, the complicated and hazardous production and the associated high cost are a significant issue.

U.S. Pat. No. 3,902,933 A discloses an initial explosive charge for detonation of nitromethane. The initial explosive charge is formed by a polyurethane foam containing dispersed microspheres. The microspheres can be hollow glass microspheres, resin beads, ceramic beads, etc.

Further disclosed, in U.S. Pat. No. 4,334,476 A, is an initial explosive charge for granular or liquid explosives, with an interior channel to hold the ignition device, whereby the interior channel exhibits a small wall thickness so as to improve the detonation. This ensures the separation of the liquid explosive and the ignition device.

Finally, U.S. Pat. No. 3,797,392 A discloses microspheres, used for the sensitization of liquid explosives. These microspheres, such as hollow glass spheres, ceramic microspheres or silicon carbide, are dispersed in the liquid explosive right away and subsequently ignited. The use of open-pored polyurethane foams is described as well.

DETAILED DESCRIPTION OF THE INVENTION

Therefore, the task of the invention is to specify an IG detonator that can be used safely, is inexpensive and safe to manufacture, and can be handled with no risk to health.

The task is solved with a detonator-sensitive booster charge according to claim 1. Advantageous embodiments are specified in the dependent claims.

According to the invention, a detonator-sensitive booster charge comprising a mixture including a nitroalkane and a cavity-forming means, as well as a slot for an ignition device, is suggested.

Surprisingly, it was found that nitroalkanes are well-suited for use in detonator-sensitive booster charges.

Nitroalkanes can be activated chemically, e.g. by addition of amine, and/or mechanically via the creation of small hollow spaces or gas-filled cavities (foaming), i.e. they become detonator sensitive and behave like volatile explosives. In order to maintain a uniform distribution of the cavity formers, the addition of a thixotropic agent is indicated. Such mixtures are disclosed in U.S. Pat. No. 3,713,915.

Nitromethane mixtures, which are produced with commercially available hollow glass microspheres (glass microballoon, GMB) and which detonate at more than 6000 m/s and are detonator-sensitive, are also known (Presles et al. Shock Waves, April 1995, Volume 4, Issue 6, p. 325-329).

In one embodiment of the invention, the detonator-sensitive booster charge is made of a liquid-impermeable material. This prevents leaking of the nitroalkane.

In a further embodiment of the invention, the detonator-sensitive booster charge exhibits a concave curvature arranged on the opposite side of the slot for the ignition device. In the sense of the present invention, a concave curvature is a conical or hemispherical curvature on the direction of the center of the booster charge. With the concave curvature the effect of a hollow charge is achieved, which results in an increased detonation velocity. The curvature causes the energy released by the detonation to be focused in this direction. For this reason the booster charge is inserted with the concave curvature in the direction of the main charge. The advantageous design with concave curvature significantly increases the effectiveness of the inventive booster charge.

In a further embodiment of the invention, the concave curvature exhibits a metallic coating. The metallic coating can be made of aluminum and applied to the surface of the concave curvature by spraying, steaming or as a metallic film. The metallic coating of the concave curvature affects an intensifying initial pulse in a specified direction.

The concave curvature with a metallic coating is of particular importance for achieving a high chemical implementation rate, in which the implementation process comes very close to the theoretical value. This significantly reduces the level of harmful substances in the borehole column charge for the commercial explosives to be activated.

In another embodiment of the invention, the ignition device is a blasting cap, a detonating cord or a non-electric detonator.

In a further embodiment of the invention, the detonator-sensitive booster charge exhibits a suitable wall thickness. This ensures a secure ignition transfer from the cap or the cord to the nitroalkane mixture. The wall thickness is dependent on the material of the wall as well as the mixture used.

In a further embodiment of the invention, the nitroalkane is selected from a group with 1 to 3 carbon atoms.

In a further embodiment of the invention, the nitroalkane is nitromethane.

In a further embodiment of the invention, the cavity-forming means is configured as a hollow glass microsphere.

In a further embodiment of the invention, the cavity-forming means is configured as a hollow glass microsphere with a grain size of 20-200 μm, preferably 40-150 μm, particularly preferred 80-120 μm.

In a further embodiment of the invention, the cavity-forming means is configured as a hollow glass microsphere with a grain size of substantially 100 μm.

In a further embodiment of the invention, the mixture includes Aerosil. In this context Aerosil is a fumed silica.

In a further embodiment of the invention, the mixture exhibits 1.5-10 weight %, preferably 3-8 weight %, particularly preferred 5-7 weight % Aerosil, 0.2-10 weight %, preferably 0.5-5 weight %, particularly preferred 0.8-2 weight % hollow glass microspheres and 85-98.3 weight %, preferably 89-95, particularly preferred 91-93 weight % nitromethane.

In a further embodiment of the invention, the mixture exhibits 6.5 weight % Aerosil, 1 weight % hollow glass microspheres with a grain size of substantially 100 μm and 92.5 weight % nitromethane.

In a further embodiment, the mixture also comprises at least one oxygen-containing compound selected from the nitrates group to increase the oxygen balance. In one design of the embodiment, the oxygen-containing compound is ammonium nitrate.

The use of the inventive detonator-sensitive booster charge is also the subject matter of the invention.

FIG. 1 is a drawing of a non-limiting example of a detonator-sensitive booster charge as herein disclosed.

The inventive detonator-sensitive booster charges are used to initiate non-detonator-sensitive commercial explosives, preferentially in boreholes on the surface and below ground, to initiate larger amplifier charges and for direct use for special blasting (avalanches, ice etc.). In particular, the inventive detonator-sensitive booster charges are used for the initiation of explosives in mining applications and tunnel construction.

In doing so the inventive detonator-sensitive booster charges exhibit the following advantages:

Detonation velocities of ca. 6000 m/s are achieved with the inventive detonator-sensitive booster charges, allowing the detonation of non-detonator-sensitive explosives. Moreover, no nitroaromatics, which are suspected to be carcinogenic, and no nitroesters, which are physiologically problematic due to possible vasodilation, are formed when the detonator-sensitive booster charges are used. Health problems among users can thus be avoided. In addition, the inventively preferred nitroalkane nitromethane is an inexpensive product that, due to the gas-phase nitration of propane, is available for the long term—even when recycled military explosives become scarce.

Nitromethane is also not a classic explosive, which makes transport and storage inexpensive, and is of storage class 3 (flammable liquids). In addition, nitromethane has low toxicity: LD50 oral rat: 940 mg/kg, WHC 2.

It is also advantageous that, in the event of damage, the inventive detonator-sensitive booster charges "deactivate" themselves by complete volatilization of the nitromethane into the air.

The inventive detonator-sensitive booster charges are designed to be absolutely waterproof and temperature-resistant. There is no exudation of fluids. Thus, because there are no chemical reactions between the mixture components, the inventive detonator-sensitive booster charges in a mixture with Aerosil and GMBs have a practically unlimited shelf life.

Moreover, the manufacturing of the inventive detonator-sensitive booster charges invention does not require dangerous melting processes. In addition, no long waiting period is necessary after mixing of the components, which is why manufacturing can be easily and safely (away from people) automated.

It is also important that the components in the mixture are not explosive materials, necessitating only minor storage and transportation costs.

Preferred embodiments of the invention result from combinations of the claims or individual features thereof.

In the following, the invention will be described in detail with reference to several design examples. The design examples are intended to describe the invention without limiting it.

In one design example of the invention, pure ammonium nitrate and ANFO (in each case with 13 g of the inventive composition in a cylindrical booster charge) with the following composition were brought to a detonative reaction: 6.5% Aerosil, 1% GMBs ca 100 μm, 92.5% nitromethane.

In the process, detonation velocities of ca. 4500 m/were measured, which indicates adequate suitability of the mixture for the initiation of non-detonator-sensitive commercial explosives to initiate larger amplifier charges and for direct use for special blasting (avalanches, ice, etc.).

A non-limiting example of a detonator-sensitive booster charge as herein disclosed is illustrated in FIG. 1. FIG. 1 shows a detonator sensitive booster charge 1, an ignition device 2, a mixture comprising nitromethane and cavity forming means 3, and a concave curvature 4.

What is claimed is:

1. A detonator-sensitive booster charge for use in blasting engineering comprising a mixture including a nitromethane and a cavity-forming means, wherein the cavity-forming means is configured as a hollow glass microsphere, and fumed silica, as well as a receptacle for an ignition device, wherein the booster charge is configured so as to be waterproof and temperature-resistant and comprises a concave curvature arranged on an opposite side of the receptacle for the ignition device.

2. The detonator-sensitive booster charge according to claim 1, wherein the booster charge is made of a liquid-impermeable material.

3. The detonator-sensitive booster charge according to claim 1, wherein the concave curvature comprises a metallic coating.

4. The detonator-sensitive booster charge according to claim 1, wherein the ignition device comprises a blasting cap, a detonating cord or a non-electric detonator.

5. The detonator-sensitive booster charge according to claim 1, wherein the cavity-forming means is configured as a hollow glass microsphere with a grain size of 20-200 μm.

6. The detonator-sensitive booster charge according to claim 1, wherein the mixture comprises 1.5-10 weight % fumed silica, 0.2-10 weight % hollow glass microspheres and 85-98.3 weight % nitromethane.

7. The detonator-sensitive booster charge according to claim 1, further comprising an oxygen-containing compound selected from the nitrates group.

8. The detonator-sensitive booster charge according to claim 5, wherein the cavity-forming means is configured as a hollow glass microsphere with a grain size of 40-150 μm.

9. The detonator-sensitive booster charge according to claim 5, wherein the cavity-forming means is configured as a hollow glass microsphere with a grain size of 80-120 μm.

10. The detonator-sensitive booster charge according to claim 6, wherein the mixture exhibits 3-8 weight % fumed silica, 0.5-5 weight % hollow glass microspheres, and 85-95 weight % nitromethane.

11. The detonator-sensitive booster charge according to claim 10, wherein the mixture exhibits 5-7 weight % fumed silica, 0.8-2 weight % hollow glass microspheres, and 91-93 weight % nitromethane.

12. A detonator-sensitive booster charge for use in blasting engineering comprising;

a mixture and a receptacle for an ignition device, wherein the mixture comprises 85%-98.3% by weight nitromethane, 1.5%-10% by weight fumed silica, and 0.2%-10% by weight a cavity-forming means wherein the cavity-forming means comprises hollow glass microspheres, and the booster charge is configured so as to be waterproof and temperature-resistant.

13. The detonator-sensitive booster charge according to claim 12, wherein the booster charge is made of a liquid-impermeable material.

14. The detonator-sensitive booster charge according to claim 12, wherein the booster charge comprises a concave curvature arranged on an opposite side of the receptacle for the ignition device.

15. The detonator-sensitive booster charge according to claim 14, wherein the concave curvature comprises a metallic coating.

16. The detonator-sensitive booster charge according to claim 12, wherein the ignition device comprises a blasting cap, a detonating cord or a non-electric detonator.

17. The detonator-sensitive booster charge according to claim 12, wherein the cavity-forming means is configured as a hollow glass microsphere with a grain size of 20-200 μm.

18. The detonator-sensitive booster charge according to claim 12, wherein the mixture comprises 92.5% by weight nitromethane 6.5% by weight fumed silica, and 1% by weight hollow glass microspheres having a grain size of substantially 100 μm.

19. The detonator-sensitive booster charge according to claim 12, further comprising an oxygen-containing compound selected from the nitrates group.

20. The detonator-sensitive booster charge according to claim 17, wherein the cavity-forming means is configured as a hollow glass microsphere with a grain size of 40-150 μm.

21. The detonator-sensitive booster charge according to claim 17, wherein the cavity-forming means is configured as a hollow glass microsphere with a grain size of 80-120 μm.

22. The detonator-sensitive booster charge according to claim 12, wherein the mixture exhibits 3-8 weight % fumed silica, 0.5-5 weight % hollow glass microspheres, and 85-95 weight % nitromethane.

23. The detonator-sensitive booster charge according to claim 22, wherein the mixture exhibits 5-7 weight % fumed silica, 0.8-2 weight % hollow glass microspheres, and 91-93 weight % nitromethane.

24. A detonator-sensitive booster charge for use in blasting engineering comprising;

a mixture and a receptacle for an ignition device, wherein the mixture comprises 92.5% by weight nitromethane, 6.5% by weight fumed silica, and 1% by weight a cavity-forming means wherein the cavity-forming means comprises hollow glass microspheres having a grain size of substantially 100 μm, and the booster charge is configured so as to be waterproof and temperature-resistant and comprises a concave curvature arranged on an opposite side of the receptacle from the ignition device.

* * * * *